US009889987B2

(12) United States Patent
Gallet

(10) Patent No.: US 9,889,987 B2
(45) Date of Patent: Feb. 13, 2018

(54) PREVENTION OF LIQUID OVERFLOW FROM AN OUTSIDE LIQUID STORAGE INSTALLATION

(71) Applicant: TOTAL RAFFINAGE CHIMIE, Courbevoie (FR)

(72) Inventor: Claude Gallet, Guitrancourt (FR)

(73) Assignee: TOTAL RAFFINAGE CHIMIE, Courbevoie (FR)

( * ) Notice: Subject to any disclaimer, the term of this patent is extended or adjusted under 35 U.S.C. 154(b) by 63 days.

(21) Appl. No.: 14/653,304

(22) PCT Filed: Dec. 23, 2013

(86) PCT No.: PCT/FR2013/053246

§ 371 (c)(1),
(2) Date: Jun. 18, 2015

(87) PCT Pub. No.: WO2014/102499

PCT Pub. Date: Jul. 3, 2014

(65) Prior Publication Data

US 2015/0336738 A1 Nov. 26, 2015

(30) Foreign Application Priority Data

Dec. 28, 2012 (FR) ..... 12 62918

(51) Int. Cl.
*B65D 90/24* (2006.01)
*B65D 90/12* (2006.01)

(52) U.S. Cl.
CPC ..... *B65D 90/24* (2013.01); *B65D 90/12* (2013.01)

(58) Field of Classification Search
CPC ..... B65D 90/24; B65D 90/12; B65D 90/22
USPC ..... 220/560.03; 405/53, 55, 107–127; 244/114 B; 256/12.5, 13
See application file for complete search history.

(56) References Cited

U.S. PATENT DOCUMENTS 3,007,539 A * 11/1961 Brewer ..... G10K 11/20 160/165
3,010,684 A * 11/1961 Phillips ..... B64F 1/26 244/114 B
3,930,590 A * 1/1976 Ebbrell ..... F17C 13/126 220/560.03

(Continued)

FOREIGN PATENT DOCUMENTS

DE 30 15 588 A1 10/1981
DE 10 2004 002217 A1 8/2005
DE 10 2005 053911 A1 2/2007

OTHER PUBLICATIONS

International Search Report of PCT/FR2013/053246 dated Mar. 5, 2014.

*Primary Examiner* — Andrew Perreault
(74) *Attorney, Agent, or Firm* — Sughrue Mion, PLLC

(57) ABSTRACT

The invention relates to a device (11) for the prevention of liquid overflow from an outside installation comprising a storage tank (10) for said liquid and a liquid retaining means (12) arranged around said tank, said device comprising a plate element (111, 112, 113) to be arranged between the tank and the retaining means, said plate element defining an impact surface (131, 132, 133) hit by the liquid overflowing onto said plate in the event of a rupture of the tank and openings distributed over said surface and through said plate element in order to reduce the kinetic energy of the liquid.

11 Claims, 3 Drawing Sheets

(56) References Cited

U.S. PATENT DOCUMENTS 6,199,329 B1 3/2001 Witter

* cited by examiner

PREVENTION OF LIQUID OVERFLOW FROM AN OUTSIDE LIQUID STORAGE INSTALLATION

CROSS REFERENCE TO RELATED APPLICATIONS

This application is a National Stage of International Application No. PCT/FR2013/053246 filed Dec. 23, 2013, claiming priority based on French Patent Application No. 12 62918, filed Dec. 28, 2012, the contents of all of which are incorporated herein by reference in their entirety.

The invention relates to the prevention of overflow out of an outdoor installation for storing this liquid, and in particular to an installation for storing fuels.

A liquid storage installation conventionally includes one or more tanks or reservoir(s), for example combustible-product storage tanks, and a retention means for this liquid around the reservoir(s), for example a wall or bund forming a retention pond.

Such a barrier-forming means is designed with dimensions that make it possible to contain all of the volume of liquid contained in the tank. Thus, if the liquid flows sufficiently slowly out of the storage tank, the liquid remains confined in the installation.

However, in the event of a violent rupture, as a result of the tank cracking for example, there is a risk that some of the liquid will spill out of the installation. Specifically, if the tank has a breach such that the liquid flows out with a certain amount of kinetic energy, some of the liquid can overflow beyond the retention means, this resulting in environmental pollution.

Such a violent rupture can be caused in particular by tank corrosion, which can be substantial when the liquid is crude oil, and/or by variations in the mechanical stresses applied to the perimeter of the tank in contact with the bottom depending on the level of filling of the tank.

There is a need for better protection of the environment.

Disposing a shielding obstacle, of the second-wall type, between the tank and the wall has been considered, but in the event of the tank rupturing, the liquid spilling onto this second wall risks forming a wave on account of the impact against this wall, on account of the dynamic pressure exerted on the wall. The quantity of liquid that is able to cross the retention means risks being relatively high.

Adding an external confinement to the retention pond has also been considered, but this addition may be difficult to provide on existing installations. In addition, in the event of a pool fire, in the case of hydrocarbons, the fire risks being difficult to control.

Finally, in the case of oil storage tanks, making the operations of opening the tanks more frequent in order to remove the sediments has been considered, in order to better control the corrosion of the tanks and to limit the risk of violent rupture. However, this involves increased maintenance.

A device is proposed for preventing liquid overflow out of an outdoor installation comprising a storage tank for this liquid and a liquid retention means disposed around this tank, comprising a plate element intended to be disposed between the tank and the retention means, this plate element defining an impact surface for liquid spilling onto this plate in the event of the tank rupturing and openings distributed over this surface and through this plate element in order to reduce the kinetic energy of this liquid.

Thus, rather than a shielding obstacle that risks causing the liquid to form a wave, a plate element that is pierced with orifices, for example, is installed. At least some of the liquid spilling onto this plate passes through the orifices in the plate. The velocity vectors of the elementary volumes of the liquid can thus be in various directions, and thus can result in a rapid decrease in the kinetic energy of all of the liquid following the impact. Thus, the liquid undergoes a pressure drop following the impact with the perforated plate, such that if the retention means is subsequently reached, the risk of overflow is lower than in the prior art.

Advantageously, and in a nonlimiting manner, the porosity associated with the openings in the plate element may vary between 10% and 40%, inclusive.

Advantageously, and in a nonlimiting manner, the openings may have a flow cross section that varies between 0.001 and 0.01 $m^2$, advantageously between 0.002 and 0.006 $m^2$, limits included.

Advantageously, and in a nonlimiting manner, the number of openings per $m^2$ of impact surface may vary between 10 and 200, advantageously between 20 and 150, limits included.

The plate element, also referred to improperly as plate in the present application, can define a planar or non-planar impact surface. For example, it may be possible to provide a plate element that defines a relatively curved impact surface, for example with a radius of curvature close to that which a circle on which a number of plate elements surrounding the tank are disposed would have.

In the present description, the expression plane of the plate element will be used to denote either the plane of a flat impact surface or a tangent plane or a mid-plane of this impact surface.

The openings may be distributed homogeneously or non-homogeneously. They may be for example orifices having a closed contour, for example circular, elongate, square orifices or else, that are defined in the plate. Provision can also be made of rectilinear openings. For example, the plate element may comprise a set of inclined slats, in the manner of a blind, so as to form an opening between each pair of two adjacent slats. Advantageously, the longitudinal edges of the slats may be horizontal, and the inclination of the slats may be such that the openings define passages that guide the liquid toward the ground.

The orifices may form a conduit through the thickness of the plate, and/or beyond the plate. Provision could be made for example to weld tubes that lead onto a surface of the plate opposed to the impact surface, at locations corresponding to the orifices in the plate.

Advantageously, however, simpler forms, of the perforated sheet or expanded sheet type, for example, will be chosen.

Advantageously, and in a nonlimiting manner, the device may also include a support means for the plate element, in order to keep the plate element standing with respect to the ground.

"Plane of the ground" means the plane tangent to the ground at the location at which the plate is standing.

The invention is not limited by the form of the support means: it may be for example a frame that is intended to be placed on the ground and defines a groove into which a rim of the plate may be inserted, or else.

The dimensions of the plate element and of the impact surface are chosen so as to allow a significant reduction in the kinetic energy of the fluid spilling onto this plate element in the event of the tank rupturing.

Advantageously, and in a nonlimiting manner, the plate element and/or the impact surface may have a height greater than or equal to 50 centimeters, advantageously greater than or equal to 1 meter, advantageously between 1 and 4 meters, these limits being included.

Advantageously, and in a nonlimiting manner, the plate element and/or the impact surface may have a width greater than or equal to 50 centimeters, advantageously greater than or equal to 1 meter, advantageously between 1 and 6 meters, these limits being included.

The dimensions of the impact surface may be chosen depending on the dimensions of any breaches of which the effects are intended to be controlled.

For example, plate elements that are each able to capture and thus to reduce the energy associated with a breach of dimensions 2 meters×2 meters at the first cylindrical hollow piece of a reservoir may be envisioned. Each plate element could thus have a height greater than or equal to 2 meters and a width greater than or equal to 2 meters, it being understood that this plate element is intended to be positioned with its normal vector substantially in the direction of the potential flow. When the pollution caused by a more significant breach, for example having a height of 3 meters and a width of 90 meters (i.e. an angular breach of about 120° in a reservoir cylindrical hollow piece with a diameter of 86 meters), is intended to be limited, the choice could be made to place a number of plate elements in a contiguous way around the tank.

Advantageously, and in a nonlimiting manner, the device may be arranged such that at least one (and advantageously all of the) opening(s) define(s) a passage for the flow of liquid in a direction that forms an angle with the horizontal, advantageously an angle greater than 10°, for example around 15°. The liquid passing through the plate can thus be redirected toward the ground, thereby making it possible to further limit the formation of a wave.

Advantageously, and in a nonlimiting manner, the support means may be arranged such that the standing plate is inclined with respect to the vertical (in this case the direction normal to the plane of the ground), advantageously at an angle greater than 10°, for example around 15°. Thus, the plate could be disposed such that the plate forms with the ground an acute angle for the liquid spilling from the storage tank, rather than a springboard. Such a disposition can make it possible to limit the formation of a wave and to guide the liquid toward the ground.

Advantageously, and in a nonlimiting manner, the device may be arranged such that at least one (and advantageously all of the) opening(s) define(s) a passage for the flow of liquid in a direction that forms a non-zero angle with a direction of a vector normal to the plane of the plate, for example greater than 20°, for example around 30°. Thus, even by disposing the plate such that the plane thereof forms an angle of close to 15° with the vertical, the orifices can make it possible to guide the liquid toward the ground, at an angle of close to 15° with the horizontal.

Advantageously, and in a nonlimiting manner, the device may be arranged such that the impact surface and/or the openings in the plate is/are oriented so as to guide the liquid toward the ground.

Advantageously, and in a nonlimiting manner, the support means may be arranged such that the standing plate is inclined with respect to the normal to the plane of the ground when it is installed on the ground, so as to form a first angle with this normal, and at least one plate element may be arranged such that at least one (and advantageously all of the) opening(s) define(s) a passage for the flow of liquid in a direction that forms a second angle with a direction of a vector normal to the plane of the plate, this second angle having a value greater than that of the first angle and an orientation such that the liquid arriving on the side of the plate element such that the plate element and the ground form an acute angle in order that this liquid is guided toward the ground while it passes through said at least one opening.

Advantageously, and in a nonlimiting manner, the device may comprise a plurality of plate elements, for example two, three or four plate elements, disposed so as to form a superposition of plate elements. Thus, the liquid which passes through the orifices in a first plate element comes into contact with a second plate element that also defines orifices. This superposition of perforated plates can thus be involved in the pressure drop of the liquid spilling from the damaged tank.

Advantageously, and in a nonlimiting manner, the device may be arranged such that, for at least two plate elements, the directions of flow of liquid through these plate elements are different. Provision could be made for example of an angular difference of greater than 10°, for example of around 15° or 30°. Thus, at least one (and advantageously all of the) orifice(s) in one of the plate elements define(s) a passage for the flow of liquid in a different direction than that of the passage defined by at least one (and advantageously all of the) orifice(s) in another plate element. These two plate elements can be adjacent in the superposition of plate elements of the device, or not.

Advantageously, and in a nonlimiting manner, the device may comprise a perforated sheet and an expanded sheet, the perforated sheet being disposed upstream of the expanded sheet with respect to the direction of flow of the liquid coming from the tank, or alternatively downstream thereof.

Advantageously, and in a nonlimiting manner, the device may comprise a first plate element, a second plate element and a third plate element. The first and the third plate elements can be similar and be disposed on either side of the second plate element.

The first and the third plate elements may each comprise an expanded sheet.

The second plate element may comprise a perforated sheet.

Advantageously, and in a nonlimiting manner, the percentage of voids in the perforated sheet varies between 10% and 40%, these limits being included. The perforations may be round, elongate, or else.

The thickness of the perforated sheet may vary between 0.4 mm and 10 mm.

The thickness of the sheet employed to manufacture the expanded sheet may vary between 0.4 mm and 10 mm.

When the sheet is relatively thin, for example for a thickness less than or equal to one millimeter, the device may be designed for single use. In the event of the tank rupturing, the device for preventing overflow is then replaced.

For the expanded sheet, provision could be made of a strip width that varies between 1 and 20 mm, for example between 5 and 10 mm, and a mesh length of between 3 and 200 mm, advantageously between 5 and 70 mm, a mesh width of between 2 and 100 mm, advantageously between 3 and 30 mm, a strip thickness advantageously of between 1 and 5 mm, and an overall thickness of the expanded metal of between 0.5 and 50 mm, advantageously between 1 and 8 mm. The ducts thus formed make it possible to divert a part of the liquid coming into contact with the sheet.

An expanded sheet having an equivalent percentage of voids, taken in a plane at mid-thickness of the sheet, of between 10% and 40%, advantageously around 25%, could be chosen.

The sheets may be made of steel, in particular stainless steel, aluminum, brass, copper, or the like.

The expanded sheets may be produced by shearing and expanding a sheet made of a malleable metal or alloy, or alternatively by molding a metal or alloy that is less malleable, if at all, for example gray iron or zamak. Generally, the invention is in no way limited by the method for obtaining these plate elements.

Advantageously, and in a nonlimiting manner, the support means may be arranged so as to define a space between at least one (and preferably each) plate element and the ground, for the flow of liquid. Thus, by leaving for example between 5 and 20 cm, for example close to 10 cm, between the ground and the plates, liquid can flow under the plates, thereby reducing the quantity of liquid that is likely to form a wave. This space may also make it possible to limit the stagnation of liquid retained by the plates, and thus to reduce the risk of gas accumulating at the ground, and thus the risk of an explosion associated with such a blanket of gas.

Also proposed is a system for preventing liquid overflow including a plurality of devices as described above. These devices may be disposed around one or more storage tanks so as to leave passages for operators to pass through, for example in staggered rows.

Also proposed is an outside installation comprising a liquid storage tank, a liquid retention means disposed around this tank and at least one device as described above, disposed between the tank and the retention means.

The liquid may be a crude oil, be obtained from refining, or else. Even though the invention finds particularly advantageous application in the oil industry, on account of the risk of pollution associated with the stored products, it is in no way limited to liquids obtained from crude oil. It could be just as easily employed in other industries, in particular the storage of liquid fertilizer, and more generally of any liquid likely to cause environmental damage.

Also proposed is the use of the device as described above in an outdoor installation for storing liquid obtained from oil, for example crude oil or refined oil, fuels, petrochemical compounds, or else.

Also proposed is a method for preventing liquid overflow out of an outside installation comprising a tank for storing this liquid and a liquid retention means disposed around this tank, comprising a step of disposing a plate element between the tank and the retention means, this plate element defining an impact surface for the liquid spilling onto this plate in the event of the tank rupturing and openings distributed over this surface and through this plate element in order to reduce the kinetic energy of this liquid.

Advantageously, and in a nonlimiting manner, provision could be made to dispose a plurality of these devices around the tank, for example such that, for this device, one impact surface is oriented substantially toward one or more tank(s). Provision could advantageously be made to distribute these devices in a relatively regular manner around the tank(s) so as to leave passages for the evacuation of persons.

Advantageously, and in a nonlimiting manner, the prevention devices may be disposed between the first quarter and the final quarter of the distance between the storage tanks and the retention means, for example half-way between the tanks and the retention wall.

Advantageously, and in a nonlimiting manner, the prevention devices may be disposed with an orientation such that the impact surfaces of the plates face the storage tanks. The devices can thus be disposed approximately parallel to an external surface of the tank.

The invention will be better understood with reference to the figures, which illustrate nonlimiting embodiments.

Identical references can be used from one figure to another to designate identical or similar elements.

Figure 1:
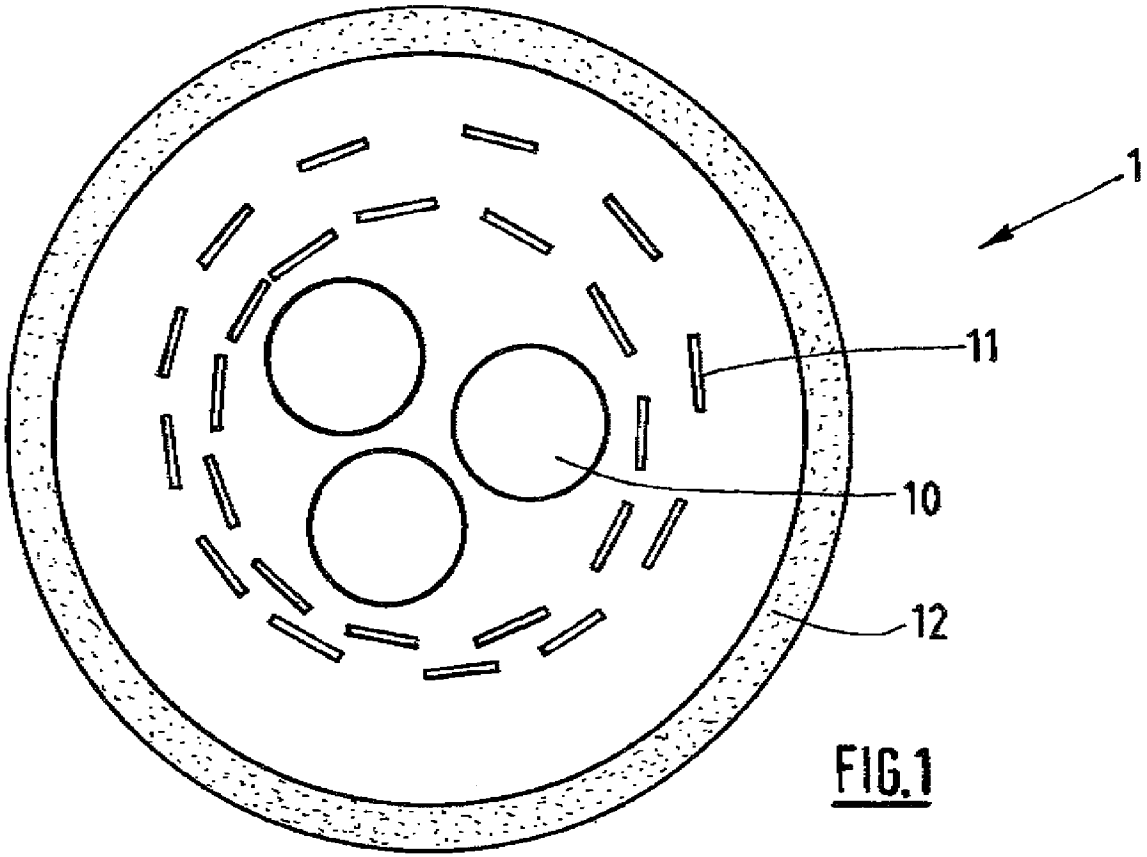
FIG. 1 is a very schematic view from above of an exemplary installation according to one embodiment of the invention.

With reference to FIG. 1, an outdoor installation 1 for storing crude oil includes reservoirs 10 positioned on the outside, in this case storage tanks for crude oil. Each tank 10 can store for example 15 000 $m^3$ of oil.

Provision can even be made of even more voluminous tanks. For example, a storage tank can measure between 3 and 30 meters in height, for example around 20 or 25 meters in height, and from 1 to 100 m in diameter, for example between 40 and 50 meters in diameter.

In the event of a violent rupture, with for example the creation of a breach of 70 cm, this volume of oil is spilled into the installation with relatively high potential energy.

A bund 12 surrounds the tanks 10 so as to form a retention pond. The height of the bund may be between 1 and 3 meters. The bunds may be situated for example at a distance of between 10 meters and 50 meters from the tanks 10.

Alternatively, a boundary wall could be provided instead of the bund.

This retention pond is dimensioned to be able to retain the volume stored in each of the tanks 10. However if the oil is spilled with relatively high kinetic energy, there is a risk of overflow or spillage.

Devices 11 for preventing oil overflow are disposed in staggered rows around the tanks 10. These devices make it possible, by way of their structure and their disposition, to reduce the kinetic energy of the oil potentially spilled from a tank 10 in the event of violent and accidental rupture of this tank 10. This disposition in staggered rows may also allow the operators to pass easily through the installation, and if need be to rapidly evacuate the installation. Finally, in the event of fire, this disposition of the devices 11 allows the spraying of extinguishing foam.

Each device comprises at least one plate element that defines an impact surface for the liquid that is likely to spill onto this plate, and defines openings distributed over this surface and through this plate element.

Table 1 below gives examples of values:

of porosity P, the porosity P being obtained by dividing the flow cross section of all of the holes in a impact surface by the surface area of this surface, of the number N of holes per $m^2$ of the plate element, of the hole diameter D, and of the flow cross section S per hole.

TABLE 1

| P in % | N | D in cm | S in $m^2$ |
|---|---|---|---|
| 10 | 20 | 8 | 0.005024 |
| 20 | 40 | 8 | 0.005024 |
| 25 | 50 | 8 | 0.005024 |
| 30 | 60 | 8 | 0.005024 |
| 40 | 80 | 8 | 0.005024 |
| 10 | 35 | 6 | 0.002826 |
| 20 | 71 | 6 | 0.002826 |
| 25 | 88 | 6 | 0.002826 |

TABLE 1-continued

| P in % | N | D in cm | S in $m^2$ |
|---|---|---|---|
| 30 | 106 | 6 | 0.002826 |
| 40 | 142 | 6 | 0.002826 |

Figure 2:
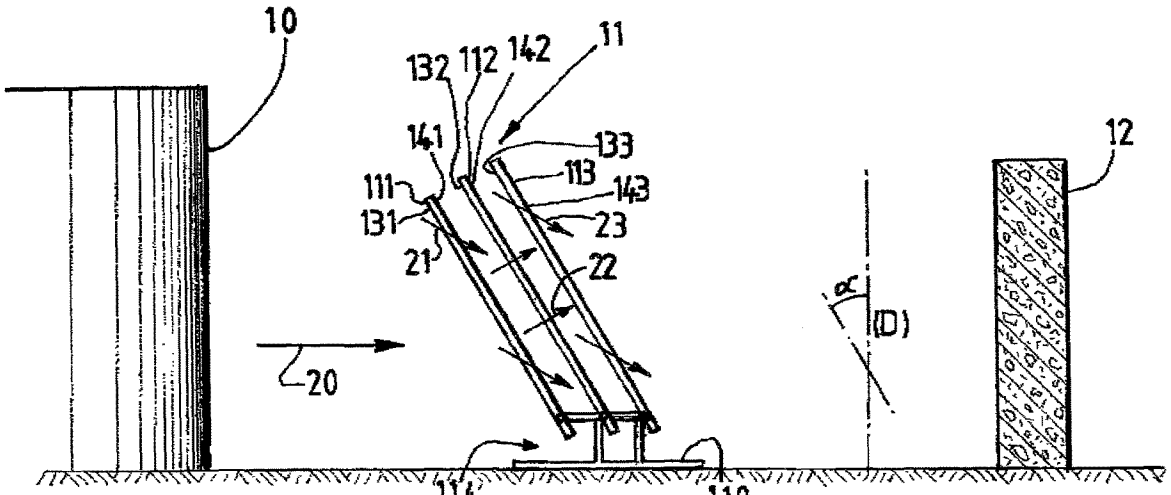
FIG. 2 is a sectional view of a part of an exemplary installation according to one embodiment of the invention.

With reference to FIG. 2, a device 11 for preventing overflow can comprise three superposed plate elements 111, 112, 113.

This FIG. 2 is not to scale.

Each plate element defines an impact surface 131, 132, 133 onto which a part of the oil coming from the tank 10 passes in the event of a violent rupture of this tank 10, and also a rear surface 141, 142, 143 opposed to the impact surface.

Moreover, each plate element 111, 112, 113 defines orifices (not shown in FIG. 2) that are distributed over the impact surface and pass through the plate element. Each orifice thus defines a duct through the corresponding plate element for the oil to pass through.

Figure 3:
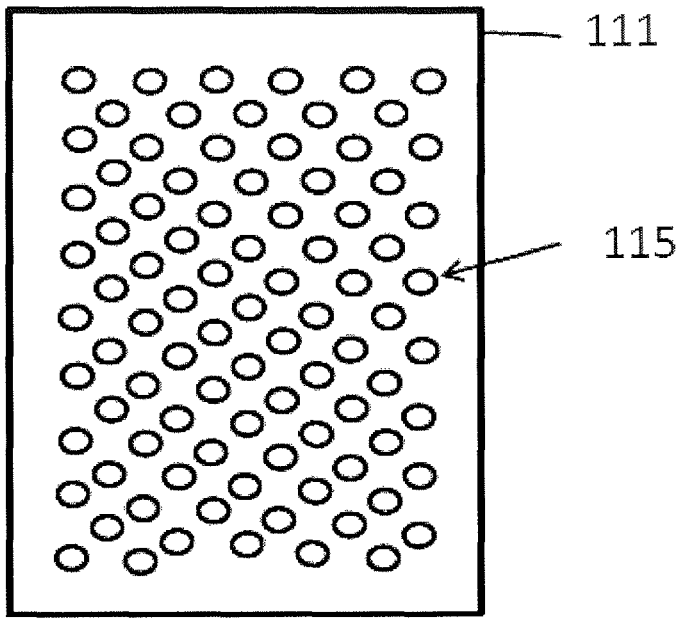
FIG. 3 is an illustrative front view of the plate element with openings according to one embodiment of the invention.

FIG. 3 shows an example of the orifices (openings) 115 in the plate member 111 in one embodiment of the invention.

The plate elements, or plates 111, 112, 113 are mounted on a support means 110. This support means is arranged so as:

on the one hand to keep the plates 111, 112, 113 relatively spaced apart from the ground so as to create a space 114 for the flow of oil in the course of evacuation; and on the other hand to keep the plates standing at an inclination with respect to the ground.

Part of the oil coming from the tank 10, which arrives at a velocity with a substantially horizontal direction, along the arrow 20, will thus pass under the plates 111, 112, 113, through the space 114, and another part will strike the impact surface 131. The inclination of the impact surface contributes to guiding the oil toward the ground.

For example, an inclination could be chosen such that the angle $\alpha$ between the plane of the plates and the vertical direction, represented in this case by the straight line (D), is between 12° and 18°, advantageously around 15°.

Furthermore, the orifices in the different plates define ducts for the flow of liquid in non-horizontal directions that are different from one plate to the adjacent plate.

Thus, the first plate 111 is an expanded metal grating for which the inclination of the strips (along the arrows 21) varies between 12° and 18°, and is advantageously around 15°, with respect to the horizontal when the plate 111 is itself inclined by close to 15° with respect to the vertical. In other words, the plate 111 is designed to form ducts inclined at close to 30° with respect to a vector normal to the plane of the plate.

The second plate 112 is a perforated plate, defining ducts through the thickness of the plate and corresponding to a direction parallel to the vector normal to the plane of this plate 112. In other words, after having been guided downward, in a direction that forms an angle of 15° with the horizontal, the liquid passing through the orifices in the plate 112 follows a path that this time has an inclination of 15° with respect to the horizontal, but upward (along the arrow 22). It will be appreciated that these variations in direction of movement cause relatively large pressure drops.

The porosity of this second plate 112 is 40%.

Finally, the third plate 113 is identical to the first plate and disposed at the same inclination. The movement of the liquid passing through the mesh of this plate 113 takes place along the arrow 23, that is to say once again toward the ground, thereby making it possible to further reduce the energy in the liquid.

The plates 111, 112, 113 may for example have dimensions of around one meter, for example between 1 and 4 meters in height and between 1 and 6 meters in width, for example 2 meters in height and 3 meters in length. In the example in FIG. 2, the elements 111, 112, 113 have different heights, but plate elements having the same dimensions could be chosen.

The space 114 may have a height of 10 or 15 cm for example. Since the device 11 is open in its bottom part, the accumulation of gas between the device 11 and the tank 10, and thus the risk of explosion, is limited.

In order to fasten the plates 111, 112, 113, frames and systems of screws, or else, may for example be provided.

Tests carried out at 1/10th scale showed that this device made it possible to avoid the formation of waves for a reservoir having an equivalent height of 20 m and split by a breach having an equivalent length of 70 cm. For these tests, use was made of a PVC tube having a diameter of 20 cm and a height of 2 meters, with a breach of 7 cm at the bottom of the PVC tube, a model of the prevention device having a height of 15 cm and a width of 20 cm being disposed at 40 cm from the PVC tube. The model of the retention means also has a height of around 15 cm and is disposed 50 cm from the PVC tube. The PVC tube is initially filled with water at 20° C.

If the first grating 111 is removed and the second sheet 112 is replaced with a similar sheet with the exception that the porosity is brought to 10%, the results remain better than in the absence of a device for preventing overflow.

If the first grating 111 is reintroduced and the second sheet is kept (with a porosity of 10%), the result remains very satisfactory in that there is virtually no overflow beyond the retention wall.

The tests have also shown that if the retention means is a bund forming a slope of 45°, it is sensible to use a second sheet 112 having a porosity of 10%, whereas for a boundary wall, a porosity of 40% is more appropriate.

In the present application, the terms "top", "bottom", "horizontal", "vertical", etc., have been used for the use of the prevention device on ground that is presumed to be horizontal, the vector of gravity then being vertical and oriented from top to bottom. However, it will be readily understood that the orientation of this device may be different, in particular during its storage, transport, etc.

The invention claimed is:

1. An outdoor installation comprising a liquid storage tank, a liquid retention means disposed around said tank and at least one device disposed between the tank and the retention means, the device preventing liquid overflow out of the outdoor installation, wherein the device comprises at least one plate element to be disposed between the tank and the retention means and a support means for the plate element, in order to keep the plate element standing with respect to a ground, said plate element defining an impact surface for liquid spilling onto this plate in the event of the tank rupturing and openings distributed over said surface and through said plate element in order to reduce the kinetic energy of the liquid, wherein the support means is arranged so as to define a space between the plate element and the ground, for the flow of liquid.

2. The outdoor installation as claimed in claim 1, wherein the space is different from the openings.

3. The outdoor installation as claimed in claim 1, wherein the space allows the flow of liquid to flow on the ground below the plate member.

4. The outdoor installation as claimed in claim 1, wherein the support means is arranged such that the standing plate element is inclined with respect to a direction normal to a plane of the ground.

5. The outdoor installation as claimed in claim 1, wherein the device is arranged such that at least one opening defines a passage for the flow of liquid in a direction that forms a non-zero angle with a direction of a vector normal to a plane of the impact surface.

6. The outdoor installation as claimed in claim 1, wherein the plate member comprises a plurality of plate elements disposed so as to form a superposition of plate elements.

7. The outdoor installation as claimed in claim 6, wherein the device is arranged such that for at least two plate elements, directions of liquid flow through said plate elements are different.

8. The outdoor installation as claimed in claim 6, wherein the plurality of plate elements comprises two expanded sheets and a perforated sheet placed between said expanded sheets.

9. The outdoor installation as claimed in claim 1, wherein the impact surface has a height of between 1 and 4 meters.

10. The outdoor installation as claimed in claim 1, wherein porosity associated with the openings is between 10% and 40%.

11. The outdoor installation as claimed in claim 1, wherein number of openings defined by the plate element is between 10 and 200 per square meter of impact surface.

* * * * *